US006348647B1

(12) United States Patent
Ahrens

(10) Patent No.: US 6,348,647 B1
(45) Date of Patent: Feb. 19, 2002

(54) FIPPLE FLUTES HAVING IMPROVED AIRWAYS

(76) Inventor: Karl P. Ahrens, 71 Hoskins Rd., Bloomfield, CT (US) 06002

( * ) Notice: Subject to any disclaimer, the term of this patent is extended or adjusted under 35 U.S.C. 154(b) by 0 days.

(21) Appl. No.: 09/539,969

(22) Filed: Mar. 31, 2000

(51) Int. Cl.[7] ..... G10D 7/02
(52) U.S. Cl. ..... 84/384; 84/380 R
(58) Field of Search ..... 84/380 R, 384, 84/382; D17/10, 11, 12

(56) References Cited

U.S. PATENT DOCUMENTS

| | | | | | |
|---|---|---|---|---|---|
| D20,998 | S | * | 8/1891 | Litzelle | D17/10 |
| 2,145,605 | A | | 1/1939 | Mausolf | |
| D142,799 | S | * | 11/1945 | Thompson | D17/10 |
| 3,815,466 | A | | 6/1974 | Johnson | |
| 4,104,948 | A | | 8/1978 | Young | |
| D258,364 | S | * | 2/1981 | Mumford | D17/2 |
| D272,159 | S | * | 1/1984 | Del Rio | D17/2 |
| 4,893,541 | A | * | 1/1990 | Fowler et al. | 84/380 C |
| D306,454 | S | * | 3/1990 | Kanamori | D17/10 |
| 5,309,806 | A | | 5/1994 | Stavash | |
| D389,855 | S | * | 1/1998 | Druz | D17/10 |

* cited by examiner

*Primary Examiner*—Robert E. Nappi
*Assistant Examiner*—Kim Lockett
(74) *Attorney, Agent, or Firm*—McCormick, Paulding & Huber LLP

(57) ABSTRACT

In a fipple flute, an instrument body includes an outer surface defining an interior resonating cavity. An airway extends from the outer surface into the resonating cavity and includes a nozzle section as well as a throat section. The instrument body defines an upper surface having a plurality of toneholes extending therethrough into the resonating cavity such that when the toneholes are covered or uncovered by a user while blowing into the airway, different notes are played by the fipple flute. At least one fipple window extends through the upper surface of the instrument body adjacent to and aligned with the throat section of the airway to allow a portion of the air blown into the flute to enter the resonating cavity and a portion of the air to exit the fipple window.

4 Claims, 2 Drawing Sheets

FIPPLE FLUTES HAVING IMPROVED AIRWAYS

FIELD OF THE INVENTION

The present invention relates gerneral to musical wind instruments, and is more specifically directed to ocarinas and the airways incorporated therein.

BACKGROUND OF THE INVENTION

Whistle flutes or fipple flutes are a family of wind instruments employing a whistle type mouthpiece, and are among the most ancient of all musical instruments. Among this family are the recorder (also known as a fipple flute or English flute), the flageolet, and the ocarina. The ocarina dates back to antiquity, and is reported to be of South American or Central American descent, though there are indications of its use in other parts of the world.

While it has been generally believed that the qualities of simplicity and limited tonal capacity were inexorably linked in ocarinas, some efforts have been made to improve their musical quality. However, these efforts have been largely unacceptable because they have failed to simultaneously overcome prior art limits on both tonal volume and tonal range.

While popular folk instruments in various circles, the acceptance of prior art ocarinas as concert-quality instruments has been hampered by certain limitations. Two common problems with prior art ocarinas are that they either lack sufficient tonal volume (i.e., loudness), sufficient tonal range (i.e., the number of notes that they can sound), or both. Ocarinas include an airway that directs a musician's airstream across a fipple window to impinge upon a fipple edge, and a series of toneholes disposed on the instrument body penetrating into at least one resonating cavity. An ocarina fipple edge that is a short distance from the point at which air exits the airway (i.e., a short fipple window) will produce a clear focused sound and will play a relatively wide range of notes. However, such an ocarina must be blown relatively softly or the sound will disappear. As a result, the sound emitted from the ocarina will be rather quiet. In addition, the size of the toneholes directly correlates to the size of the tipple window in an accurately tuned ocarina. A short fipple window and its correspondingly small toneholes contribute to a more subdued instrument because small openings do not allow soundwaves to radiate as freely from the instrument's interior into the surrounding air. Conversely, if the fipple edge is moved farther from the point at which air exits the airway (i.e., if the fipple window is made longer), the instrument's loudness will increase because of increased allowable blowing pressure and increased radiation of sound through the larger fipple window and the correspondingly larger toneholes. However, the usual result of a longer fipple window is that the tonal range will either decrease or high notes will be very airy or squeaky. Accordingly, excellent tonal range and excellent tonal volume have rarely been united in prior art ocarinas. Airway/fipple edge design is at the root of the dilemma.

Generally, prior art ocarina airways have fit into two categories: those with straight airways, and those with angled (converging) airways. A straight airway tends to produce focused sound but constricts the airstream too much to allow sufficient blowing pressure for good volume. If the straight airway is expanded to allow for increased blowing pressure, the airway will not adequately focus the airstream over the fipple edge, causing high notes to be too airy or fail to 'speak' at all. A properly and precisely made angled airway is usually superior to a straight airway because it lessens the resistance to an airstream, permitting greater blowing pressure while still focusing air over the fipple edge. However, the airstream exiting the angled airway tends to be too turbulent to support a wide tonal range with clear focused high notes. Hence, the fipple window must be brought in closer to the end of the airway, thereby reducing the loudness of the instrument.

Based on the foregoing, there is a current need for ocarinas with full sound—suitable for public performance with or without accompanying musicians—and a wider than previously attainable tonal range.

The novel airway used in the ocarina described herein consists of a nozzle section and a throat section. The nozzle section concentrates the airstream and also reduces resistance to the same, allowing greater blowing pressure. The throat section accurately aims the airstream at the fipple edge (much in the same way that a shotgun barrel tightly focuses the exiting shot) and allows the airstream to exit the airway with a minimum of counterproductive turbulence.

Accordingly, it is the general object of the present invention to overcome the drawbacks and difficulties associated with prior art ocarinas. It is a more specific object of the present invention to provide an airway for use in ocarinas that provides a concert quality enhanced tonal range.

SUMMARY OF THE INVENTION

The present invention is directed to a fipple flute having an instrument body that includes an outer surface and defines an interior resonating cavity. An airway for introducing air blown into the fipple flute by a user into the resonating cavity extends from the outer surface. The airway includes a nozzle section beginning at the outer surface and extending partway through the instrument body and a throat section extending from the nozzle section into the resonating cavity. An upper surface is defined by the instrument body that includes a plurality of toneholes which extend through the body into the resonating cavity. The toneholes are adapted to be covered or uncovered by the user while blowing into the airway to produce different notes from the fipple flute. At least one fipple window extends through the instrument body and is positioned adjacent to and aligned with the throat section of the airway, thereby allowing a portion of the air blown into the fipple flute to enter the resonating cavity and a portion of the air to exit the fipple window.

In the preferred embodiment of the present invention, the instrument body includes a body member having a lower surface and at least one upstanding wall extending about the periphery of the lower surface. The lower surface and the upstanding wall cooperate to define the resonating cavity. A cover is secured to an upper edge of the upstanding wall and thereby encloses the resonating cavity. The upstanding wall and cover cooperate to define a mouthpiece section having an outer edge with the airway extending from the outer edge into the resonating cavity. The cover includes the above-described fipple window which defines a fipple edge adjacent to an exit defined by the throat section of the airway, the fipple edge being perpendicular to an airstream exiting the throat section. The lower surface of the body member defines at least one tonehole extending therethrough into the resonating cavity adapted to be covered or uncovered by the thumb of the user while playing the instrument.

Preferably, the fipple flute is in the form of an ocarina that is generally rectangular in shape. However, the present invention is not limited in this regard as the fipple flute can also be oval-shaped without departing from the broadest aspects of the present invention.

DETAILED DESCRIPTION OF THE PREFERRED EMBODIMENT

Figure 1:
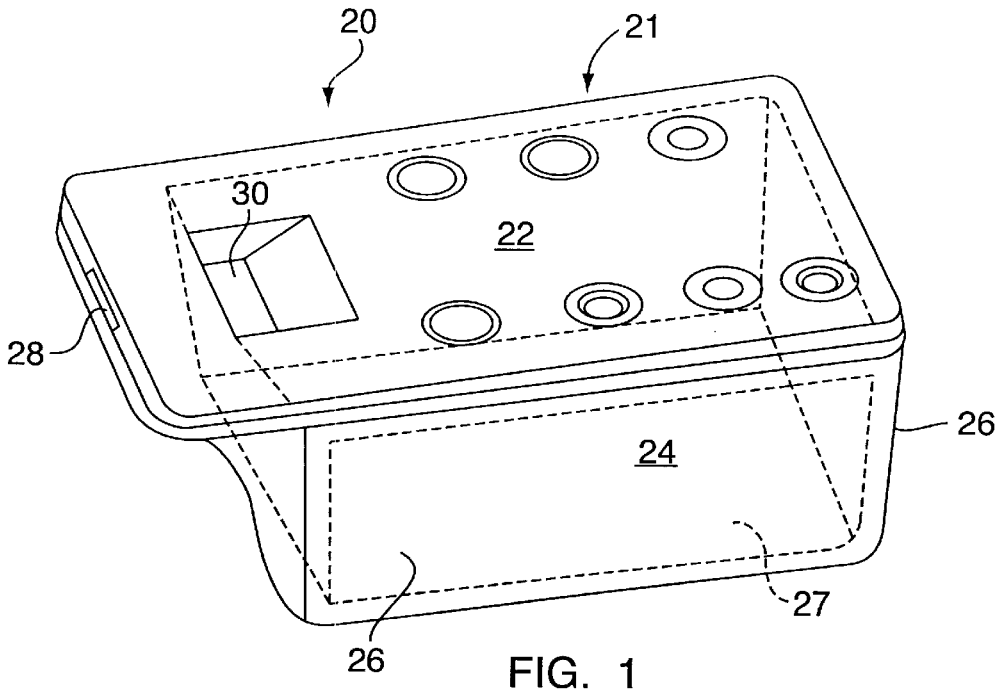
FIG. 1 is a perspective view of the preferred embodiment of the invention, an ocarina.
Figure 2:
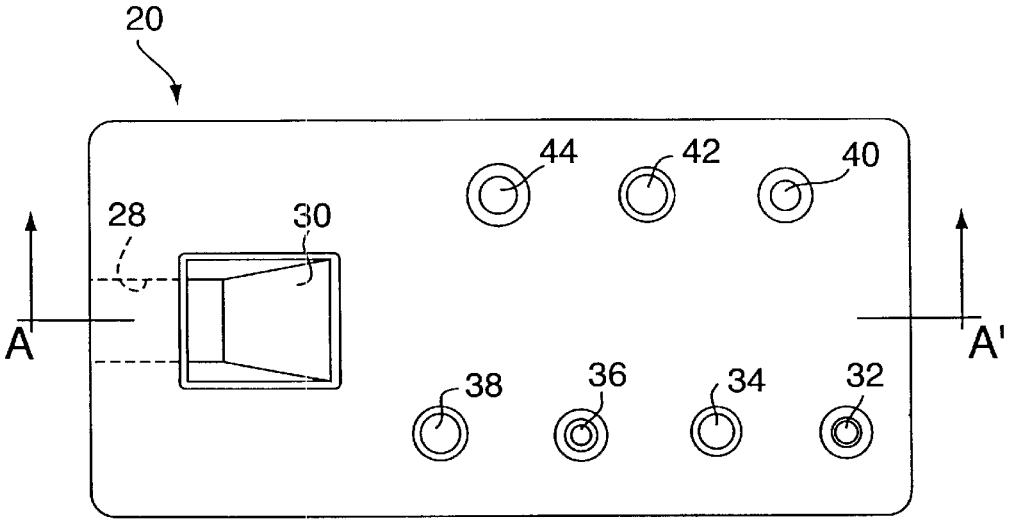
FIG. 2 is a top view showing the fipple window and the toneholes through the cover of the preferred embodiment.

As shown in FIG. 1 and FIG. 2, and generally designated by the reference number 20, an ocarina includes an instrument body 21 having a cover 22 and a body member 24. The body member 24 includes a lower surface 25 and an upstanding wall 26. The lower surface 25 and the upstanding wall 26 cooperate to form a resonating cavity 27 (shown in shadow at FIG. 1, and in profile at FIG. 3). Air blown by a musician enters an airway 28 (shown as dotted lines in FIG. 2). A fipple window 30 extends through the cover 22 as well as a plurality of toneholes 32, 34, 36, 38, 40, 42 and 44. The smaller toneholes (32 and 36 as shown) include counterbores which allow a musician to more readily feel the toneholes and to gradually slide his fingers off the toneholes.

Figure 3:
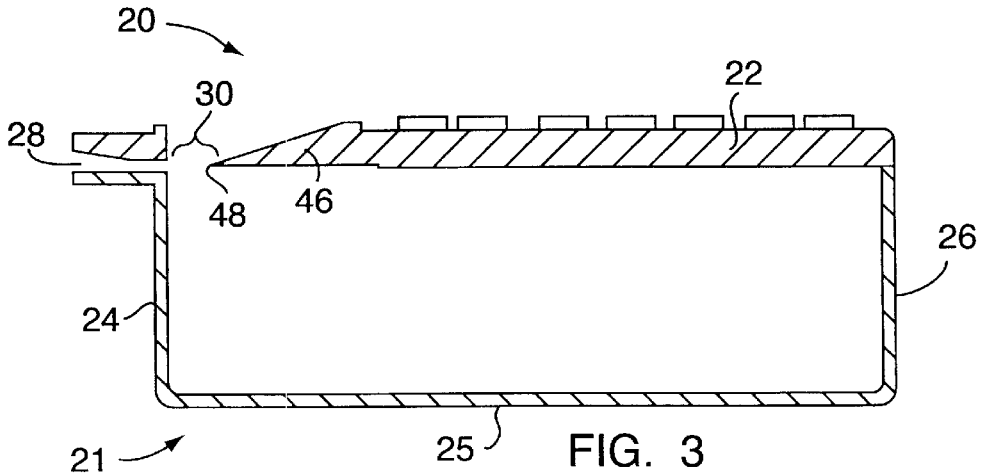
FIG. 3 is a cross section taken along section line A–A' of FIG. 2, showing the airway in relation to the instrument body.
Figure 4:
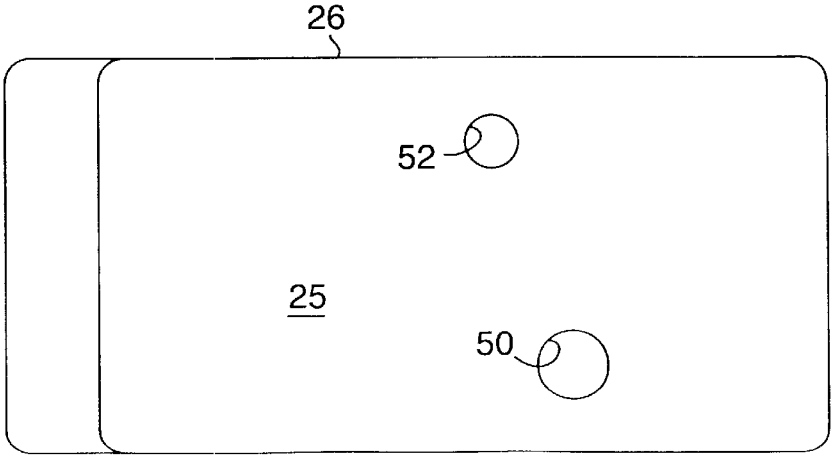
FIG. 4 is a bottom view showing the toneholes on the lower surface of the preferred embodiment.

As shown in FIG. 3, the airway 28 channels an airstream blown from the musician towards a lip 46 having a fipple edge 48. The airstream is bisected between the cavity 27 and the exterior of the instrument by the fipple edge 48, exciting the air and creating the formation of soundwaves within the ocarina's resonating cavity 27. In addition to the toneholes defined by the cover 22, and as shown in FIG. 4, the lower surface 25 also includes toneholes 50 and 52.

Figure 5:
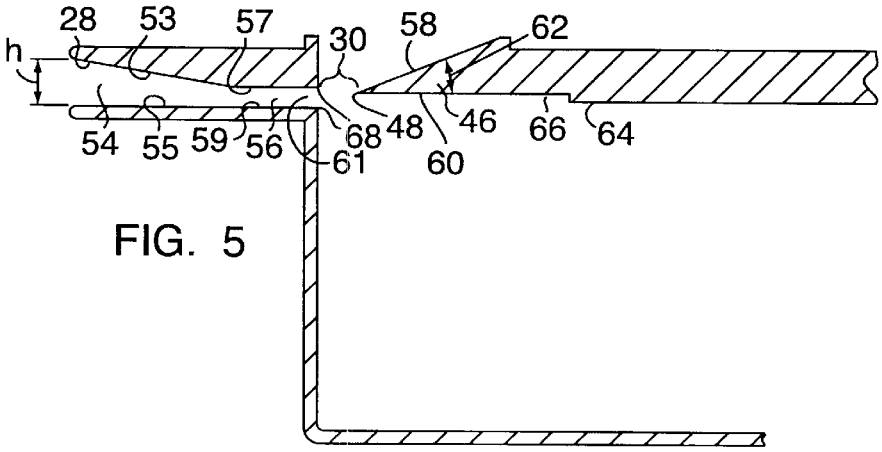
FIG. 5 is an expanded cross section taken along section line A–A' of FIG. 2 showing the airway/fipple edge arrangement in detail.

Turning to FIG. 5, the airway 28 includes a nozzle section 54 and a throat section 56. The nozzle section 54 includes an upper surface 53, and a lower surface 55, at least one of which is inclined relative to the other thereby defining a height "h" that progressively decreases toward the throat section 56. In addition, the throat section 56 defines an upper surface 57 and a lower surface 59 approximately parallel to the upper surface. The throat section 56 of the airway ensures that the airstream is properly aligned with the fipple edge 48 and reduces the turbulence of the air exiting the airway.

The lip 46 comprises an upper surface 58 and a lower surface 60, said surfaces oriented at an acute angle 62 with respect to each other and defining the fipple edge 48. The preferred embodiment employs an angle 62 of approximately 30°. However, the present invention is not limited in this regard as other angles can be employed without departing from the broader aspects of the present invention. The lower surface 60 lies in a plane slightly elevated above the resonating cavity ceiling 64 so as to define an offset cavity section 66. The offset cavity section 66 is positioned so as to precisely align the fipple edge 48 with the center of the airstream exiting the throat section 56, thereby bifurcating the airstream. Edges 68 are radiused at the exit 61 of the throat section to provide non-turbulent flow across the fipple window 30. Very sharp edges tend to introduce too great a pressure gradient around the edges shown generally at 68 and cause turbulent flow prior to the airstream's impact with the fipple edge 48. For the same reason, the corner defined by the junction of the nozzle section 54 and the throat section 56 is also radiused.

Figure 6:
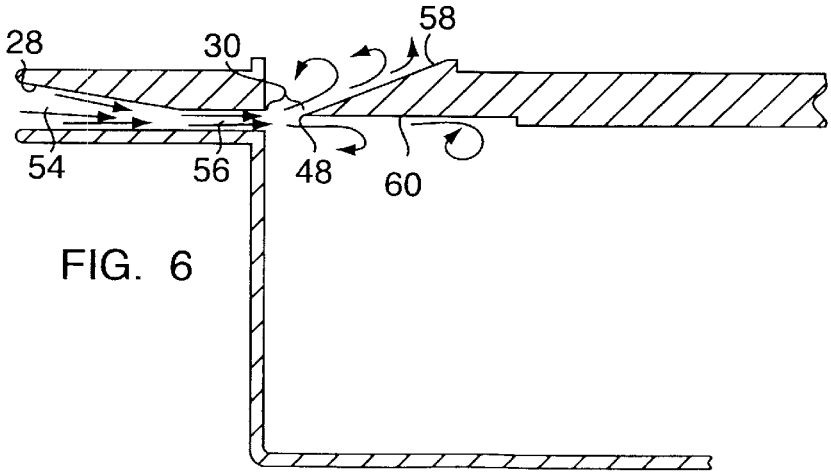
FIG. 6 is a view identical to that of FIG. 5 showing a rendition of an airstream moving through the airway and impinging the fipple edge.

As shown in FIG. 6, an airstream is concentrated in the nozzle section 54, then aligned in the throat section 56 for essentially parallel and focused flow. This flow generally continues across the length of the fipple window 30 until impinging the fipple edge 48. As the airstream passes along the upper surface 58 and the lower surface 60 of the lip 46, the cycling of different pressures above or below the fipple edge 48 sets up a vibration that causes the instrument to generate tonal sound. Covering and uncovering toneholes varies the frequencies of the soundwaves produced. The size and depth of the toneholes, rather than their precise location, determines the resulting pitch (It should be noted that tubular instruments such as the flute, trumpet or clarinet operate on different principles than vessel flutes such as ocarinas).

While preferred embodiments have been shown and described, various modifications and substitutions may be made without departing from the spirit and scope of the invention. Accordingly, it is to be understood that the present invention has been described by way of example, and not by limitation.

What is claimed is:

1. A fipple flute comprising:

an instrument body having an outer surface defining an interior resonating cavity, an airway extending from the outer surface of said instrument body into the interior resonating cavity having a nozzle section extending from the outer surface having an upper nozzle surface and a lower nozzle surface, and a throat section extending from the nozzle section into the resonating cavity, wherein at least one of the upper and lower nozzle surfaces is inclined causing a height defined by the nozzle section to progressively decrease from the outer surface of said instrument body to a junction defined by the nozzle section and the throat section, and an upper surface defining a plurality of toneholes extending into the interior resonating cavity such that when the toneholes are covered or uncovered by a user while blowing into the airway, different notes are played by said fipple flute; and at least one fipple window extending through the upper surface adjacent to and aligned with the throat section of the airway to allow a portion of air blown into said fipple flute to enter the interior resonating cavity and a portion of the air blown to exit said at least one fipple window.

2. A fipple flute comprising:

an instrument body having an outer surface defining an interior resonating cavity, an airway extending from the outer surface of said instrument body into the interior resonating cavity having a nozzle section extending from the outer surface having an upper nozzle surface and a lower nozzle surface, and a throat section extending from the nozzle section into the resonating cavity, wherein each of the upper and lower nozzle surfaces is inclined such that a height defined by the nozzle section progressively decreases from the outer surface of said instrument body to a junction defined by the nozzle section and the throat section, an upper surface defining a plurality of toneholes extending into the interior resonating cavity such that when the toneholes are covered or uncovered by a user while blowing into the airway, different notes are played by said fipple flute; and at least one fipple window extending through the upper surface adjacent to and aligned with the throat section of the airway to allow a portion of air blown into said fipple flute to enter the interior resonating cavity and a portion of the air blown to exit said at least one fipple window.

3. An ocarina comprising:

an instrument body having an outer surface defining an interior resonating cavity, an airway extending from the outer surface of said instrument body into the interior resonating cavity having a nozzle section extending from the outer surface, and a throat section extending from the nozzle section into the resonating cavity, an upper surface defining a plurality of toneholes extending into the interior resonating cavity such that when the toneholes are covered or uncovered by a user while blowing into the airway, different notes are played by said ocarina, a body member having a lower surface defining a periphery, and at least one upstanding wall extending from the periphery, the upstanding wall and the lower surface cooperating to define the interior resonating cavity, and a cover secured to the body member defining the upper surface, thereby enclosing the interior resonating cavity; and at least one fipple window extending through the upper surface adjacent to and aligned with the throat section of the airway to allow a portion of air blown into said ocarina to enter the interior resonating cavity and a portion of the air blown to exit said at least one fipple window.

4. An ocarina comprising:

an instrument body having an outer surface defining an interior resonating cavity, an airway extending from the outer surface of said instrument body into the interior resonating cavity having a nozzle section extending from the outer surface, and a throat section extending from the nozzle section into the resonating cavity, an upper surface defining a plurality of toneholes extending into the interior resonating cavity such that when the toneholes are covered or uncovered by a user while blowing into the airway, different notes are played by said ocarina, a body member having a lower surface defining a periphery, and at least one upstanding wall extending from the periphery, the upstanding wall and the lower surface cooperating to define the interior resonating cavity, and a cover secured to the body member defining the upper surface, thereby enclosing the interior resonating cavity, the cover and said instrument body cooperating to form a mouthpiece section having an outer edge wherein the airway extends from the outer edge into the interior resonating chamber; and at least one fipple window extending through the upper surface adjacent to and aligned with the throat section of the airway to allow a portion of air blown into said ocarina to enter the interior resonating cavity and a portion of the air blown to exit said at least one fipple window.

* * * * *